United States Patent [19]

Thibodeau

[11] 4,252,318

[45] Feb. 24, 1981

[54] SHUFFLEBOARD CUE

[76] Inventor: John Thibodeau, Rte. 2 Box 770, Lutz, Fla. 33549

[21] Appl. No.: 970,855

[22] Filed: Dec. 18, 1978

[51] Int. Cl.[3] ..... A63B 71/00

[52] U.S. Cl. ..... 273/129 L; 273/81.2; 273/80 R; 403/19; 403/116

[58] Field of Search ..... 273/126 R, 68, 81 R, 273/129 R, 129 B, 129 A, 81.2, 80 D, 67 R, 80, 9, 80 R; 85/5 R, 5 N, 1 R, 1 K; 74/251 R; 403/19, 116, 117; 16/115

[56] References Cited

U.S. PATENT DOCUMENTS

| | | | |
|---|---|---|---|
| 664,481 | 12/1900 | Jacobs | 74/251 R |
| 1,891,130 | 12/1932 | Wilson | 273/129 B |
| 2,239,391 | 4/1941 | Krause | 273/129 B |
| 2,567,313 | 9/1951 | Bailey | 273/80 D |
| 2,717,780 | 9/1955 | Mantz | 273/80 D |
| 2,805,068 | 9/1975 | Herzer | 273/129 B |
| 3,163,422 | 12/1964 | Swardlick | 273/129 B |

FOREIGN PATENT DOCUMENTS

| | | | |
|---|---|---|---|
| 1049128 | 8/1953 | France | 273/81 R |

*Primary Examiner*—Richard C. Pinkham
*Assistant Examiner*—T. Brown
*Attorney, Agent, or Firm*—Stein & Frijouf

[57] ABSTRACT

An improved shuffleboard cue is disclosed having a handle member and yoke comprising a first and a second arm extending from the handle member. A first and second pin extend from the first and second arms for receiving a first and a second pusher for contacting a shuffleboard disc. A first and a second clip cooperates with the first and second pins to removably secure the first and second pushers enabling the pushers to be interchanged or replaced on the shuffleboard cue. The first and second pins pivotably mount the first and second pushers on the yoke of the shuffleboard cue. The handle member may optionally comprise a telescopic feature incorporating an improved rotatable locking means for locking a first handle member portion relative to a second handle member portion. The foregoing abstract is merely a resume of one general application, is not a complete discussion of all principles of operation or applications, and is not to be construed as a limitation on the scope of the claimed subject matter.

6 Claims, 13 Drawing Figures

SHUFFLEBOARD CUE

BACKGROUND OF THE INVENTION

1. Field of the Invention

This invention relates to amusement devices and more particularly to shuffleboard cues incorporating an improved system for mounting disc pushers to the shuffleboard cue. The invention also relates to a telescopic handle member having a radial expandable flexible member for locking a first handle member portion to a second handle member portion.

2. Description of the Prior Art

Shuffleboard cues have been known to the art for a number of years. In general, the shuffleboard cue comprises a handle having a gripping portion on one end and a yoke extending from the other end of the handle member. A first and a second pusher element is secured to the yoke for contacting a circular disc of the shuffleboard game. The contact between the first and second pusher elements and the shuffleboard disc is extremely critical for the speed and accuracy of the path of travel of the shuffleboard disc. Accordingly, various configurations of pusher elements have been utilized in the prior art to satisfy the needs of the various individual preferences. Unfortunately, none of the prior art devices permit a player to easily interchange pushing elements.

A further disadvantage of the prior art shuffleboard cues is the fixed relationship between the first and second pusher elements and the yoke. Accordingly, the pusher elements will wear upon continued use of the shuffleboard cue, generally changing the contact point between the pusher elements and the shuffleboard disc. Consequently, the accuracy of the shuffleboard disc deteriorates as a function of use of the shuffleboard cue.

Other prior art shuffleboard cues have incorporated a telescopic handle for adjusting the length of the handle for various size players. Unfortunately, the telescopic mechanisms of the prior art have been too costly to incorporate as a standard feature on all shuffleboard cues.

Therefore it is an object of this invention to provide an apparatus which overcomes the aforementioned inadequacies of the prior art devices and provides an improvement which is a significant contribution to the advancement of the shuffleboard art.

Another object of this invention is to provide a shuffleboard cue having a yoke with a first and a second pin extending from a first and a second arm of the yoke. The first and second pins respectively receive a first and second pusher element with a first and second clip cooperating with the pins to removably secure the first and second pusher elements to the shuffleboard cue.

Another object of this invention is to provide a shuffleboard cue wherein the yoke is substantially U-shaped and has a substantially U-shaped cross-section to increase the mechanical strength of the yoke.

Another object of this invention is to provide a shuffleboard cue comprising an improved rotatable lock means for locking a first member portion of the handle member in telescopically receivable relation to a second member portion of the handle member.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The invention is defined by the appended claims to cover the disclosed embodiments shown in the attached drawings and the equivalent thereof as set forth in the detailed discussion. For the purpose of summarizing the invention, the invention may be incorporated in a shuffleboard cue comprising a handle member having a gripping portion on one end thereof and the yoke extending from the other end of the handle member. The yoke comprises a first and a second arm extending from the handle member. First and second pin means are respectively secured to the first and second arms. A first and a second pusher element is respectively received on the first and the second pins for contacting the shuffleboard disc. First and second clip means cooperate with the first and second pins for removably securing the first and second pusher elements to the shuffleboard cue enabling the first and second pusher elements to be replaced upon removal of the first and second clips.

More specifically, the yoke is preferably a substantially U-shaped member with the first and second arms being the terminating ends of the U-shaped yoke. The yoke preferably has a U-shaped cross-section to add mechanical strength to the yoke. The first pin means extends towards the second pin means from the terminating ends of the first and second arms respectively. Each of the first and second pin means may comprise a front and a rear pin established parallel to one another. In this embodiment, each of the clip means extends about each set of the front and rear pins. The foregoing arrangement enables the first and second pusher elements to either be rotatably mounted relative to the yoke or secured in a fixed position to the yoke.

Each of the first and second pin means comprises a groove for receiving the clip means therein. Removal of the clip enables the first and second pusher elements to be replaced with pusher elements of different configurations or to be replaced upon excessive wear. The shuffleboard may incorporate pusher elements in which the forward portion of each of the pusher elements pivots downwardly by action of gravity. In the alternative, the pusher elements may be configured such that the rearward portion of each of the pusher elements pivot downwardly by action of gravity.

The handle member may optionally comprise a first and a second member portion with the first member portion being telescopically receivable in the second member portion. In this embodiment, an improved rotatable locking means secures the position of the first member portion relative to the second member portion. More particularly, the rotatable locking means comprises a threaded member such as a screw or a stud with first securing means securing the threaded member to the first member portion. Second securing means secures the threaded member relative to the second member portion upon relative rotation between the first and second members. The first securing means preferably incorporates a first flexible member which is radially expandable upon a longitudinal compression of the flexible member. A fixed longitudinal compression of the first flexible member fixes the first member portion to the threaded member. In a similar manner, second securing means includes a second flexible member which is radially expandable upon a longitudinal compression. The second flexible member cooperates with the threaded member to longitudinally compress the second flexible member upon relative rotation between the first and second member portions. In a preferred example of the invention, the second flexible member is secured to a nut which cooperates with a stud to compress the second flexible member upon relative rotation between the stud and the nut.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. In should be appreciated by those skilled in the art that the conception and the specific embodiment disclosed may be readily utilized as a basis for modifying or designing other structures for carrying out the same purposes of the present invention. It should be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Figure 1:
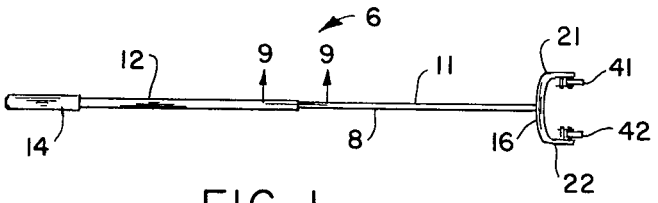
FIG. 1 is a plan view of an improved shuffleboard cue incorporating the present invention.

Similar reference characters refer to similar parts throughout the several views of the drawings. For a more clearer understanding of the invention, the following number identifications taken in connection with the detailed description and the drawings set forth the preferred mode or practice of the invention:

| | | | |
|---|---|---|---|
| 6 | cue | 51 | first clip |
| 8 | handle member | 52 | second clip |
| 11 | first member portion | 61 | aperture |
| 12 | second member portion | 61A | aperture |
| 14 | gripping region | 61B | aperture |
| 16 | yoke | 61C | aperture |
| 18 | screw | 62A | aperture |
| 20 | expansion plug | 62C | aperture |
| 21 | first arm | 64 | disc |
| 22 | second arm | 66 | pushing surface |
| 22A | surface | 68 | friction surface |
| 22B | surface | 70 | expanded tubing region |
| 31 | first pin means | 71 | first flexible member |
| 31A | front pin | 71A | aperture |
| 31B | rear pin | 72 | second flexible member |
| 32 | second pin means | 72A | aperture |
| 32A | front pin | 74 | lip |
| 32B | rear pin | 76 | screw |
| 34 | plate | 81 | first nut |
| 38 | groove | 82 | second nut |
| 41 | first pusher element | 84 | clip |
| 42 | second pusher element | 86 | projections |
| 42A | aperture | 88 | tabs |

DETAILED DESCRIPTION

Figure 2:
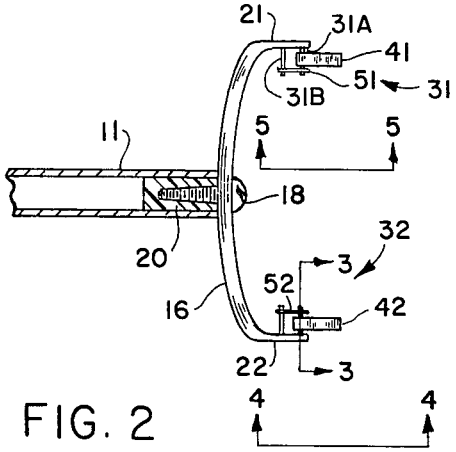
FIG. 2 is an enlarged plan view of the yoke of the shuffleboard cue shown in FIG. 1.
Figure 3:
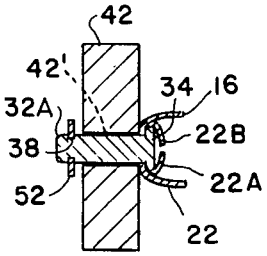
FIG. 3 is a sectional view along line 3—3 of the cue shown in FIG. 2.
Figure 4:
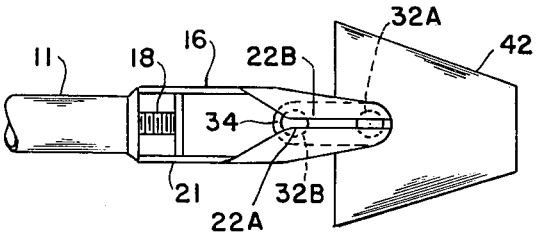
FIG. 4 is a view along line 4—4 of the cue shown in FIG. 2.

FIG. 1 is a plan view of a shuffleboard cue 6 comprising a handle member 8 having a first handle member portion 11 and a second handle member portion 12. The first handle member portion 11 is telescopically received within the second handle member portion 12 as will be hereinafter described. The second handle member portion 12 has a gripping region 14 at a terminal end thereof. The gripping region 14 may be a rubber grip or may be integrally formed into the second member portion 12. A yoke 16 shown enlarged in FIGS. 2–4, is secured to the first member portion 11 by a screw 18 engaging an expansion plug 20 disposed within the first member portion 11. The yoke 16 includes a first and a second arm 21 and 22 which form the terminal ends of the substantially U-shaped yoke 16. The yoke 16 also has a U-shaped cross-section as shown more clearly in FIG. 3. First and second pin means, shown generally as 31 and 32, are respectively secured to the first and second arms 21 and 22. Each of the first and second pin means 31 and 32 comprises a front pin 31A and 32A and a rear pin 31B and 32B established in a parallel relationship to one another. The first pins 31 extend on the inside of the yoke toward the second pins 32. The pins 32A and 32B are secured to a plate 34 which abuts yoke 16 with pins 32A and 32B extending through apertures in the yoke 16. Surfaces 22A and 22B of the U-shaped yoke 16 are bent to lock plate 34 in the position as shown in FIGS. 1–4. Pins 31A and 31B are secured in a similar manner. Each of the pins 31 and 32 comprises a groove exemplified by groove 38 in pin 32A in FIG. 3. A first and a second pusher element 41 and 42 are respectively received by pins 31 and 32 as shown in FIGS. 3 and 4. The first pusher element 41 comprises an aperture 61 which receives front pins 31A of first arms 21. The second pusher element 42 is similarly received on the front pin 32A of the second arm 22. A first and a second clip 51 and 52 are received within the grooves of the first and second pin means 31 and 32 to secure the first and second pusher elements 41 and 42. The clips 51 and 52 enable the first and second pusher elements to be replaced upon removal of the clips 51 and 52.

In a specific example of the invention, the mounting plate 34 and the front and rear pins 32A and 32B are a single master link of a chain such as a bicycle chain or the like. Clip 52 comprises a split clip of the link which is utilized to lock the pusher element 42 to the yoke 16. A similar arrangement exists for the first arm 21 and first pusher element 41.

Figure 5:
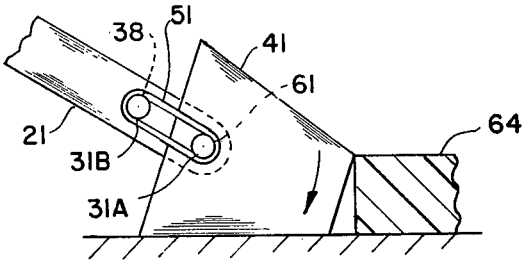
FIG. 5 is an enlarged side elevational view along line 5—5 showing a first embodiment of a shuffleboard pusher element.

FIG. 5 illustrates the first embodiment of the pusher element 41 which is shown being substantially trapezoidal in shape and having the single through aperture 61. The first pusher element 41 is secured by first clip 51 extending through the grooves 38 of the front and rear pins 31A and 31B. Aperture 61 is disposed to enable the front portion of first pusher 41 to rotate downwardly or clockwise in FIG. 5 upon action of gravity as indicated by the arrow. The pivotable mounting of the first pusher 41 insures proper contact of the pusher element 41 with the shuffleboard disc 64.

Figure 6:
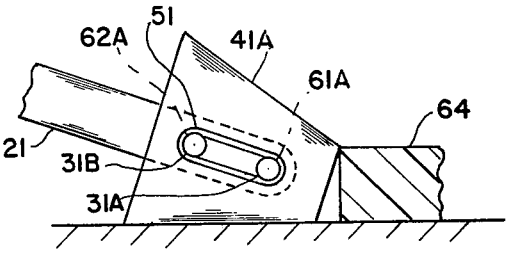
FIG. 6 is a side elevational view showing a second embodiment of a shuffleboard pusher element.

FIG. 6 is a variation of the invention showing a second embodiment of a first pusher element 41A. In this embodiment, the first pusher element 41A includes a first and a second aperture 61A and 62A for respectively receiving the front and the rear pins 31A and 31B. Clip 51 secures pusher 41A to the first arm 21. In this embodiment, the first pusher element 41A is fixed in position relative to the first arm 21.

Figure 7:
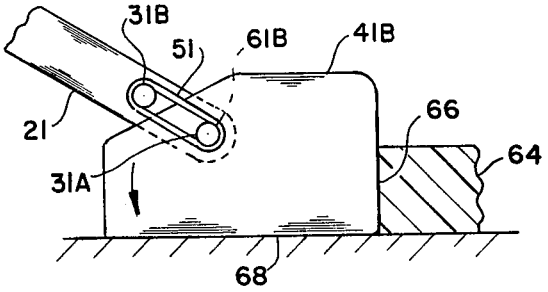
FIG. 7 is a side elevational view showing a third embodiment of a shuffleboard pusher element.

FIG. 7 illustrates a third variation of the invention showing a pusher element 41B having a single through aperture 61B for receiving the front pin 31A. This configuration enables the rear portion of first pusher 41B to rotate downwardly in FIG. 7 upon action of gravity as shown by the arrow. The pusher element 41B has a pushing surface 66 which is perpendicular to a friction surface 68 to provide a large contact area to the shuffleboard disc 64.

Figure 8:
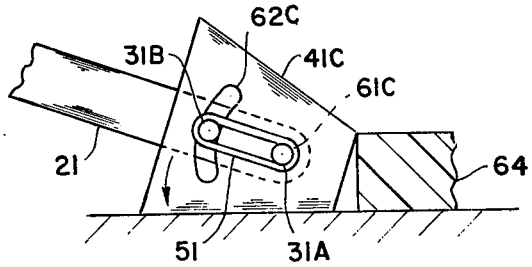
FIG. 8 is a side elevational view showing a fourth embodiment of a shuffleboard pusher element.

FIG. 8 illustrates a fourth variation of the invention showing a first pusher element 41C being substantially trapezoidal in shape and having a first aperture 61C and a second slot aperture 62C for respectively receiving the front and the rear pins 31A and 31B. In this embodiment, the rear pin 31B may move within the slot 62C enabling the rear portion of the first pusher element 41C to rotate downwardly upon action of gavity as indicated by the arrow.

The examples of pusher elements shown in FIGS. 5–8 may be interchanged on either the first or second arm 21 or 22 of the shuffleboard cue 6. Each of the pusher elements have certain distinct advantages for the variou players. The rotatable pusher elements shown in FIGS. 5, 7 and 8 enable the player to properly address the disc 64 irrespective of the angle of handle member 8 relative to the playing surface. FIG. 6 requires the handle member to be properly disposed relative to the friction surface to avoid undue wear on the front portion of the pusher element 41A. The embodiment shown in FIG. 7 has the advantage of a mutually perpendicular pushing and friction surfaces 66 and 68.

Figure 9:
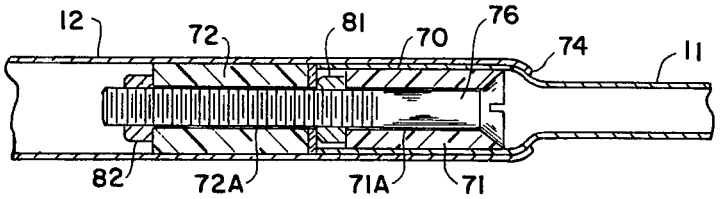
FIG. 9 is an enlarged sectional view along line 9—9 in FIG. 1 showing an improved rotatable locking means.

FIG. 9 illustrates an enlarged view of a novel rotatable locking means for locking the first member portion 11 relative to the second member portion 12. The first member portion comprises an expanded tubing region 70 which receives a first flexible member 71 therein. A second flexible member 72 is disposed within the inner region of the second member portion 12. A lip 74 limits the movement of the first and second member portions 11 and 12 and prevents separation therebetween. A threaded fastener shown as a machine screw 76 extends through an aperture 71A in a first flexible member 71 and engages with a first nut 81. Screw 76 is tightened on nut 81 thereby causing longitudinal compression of first flexible member 71 to radially expand the first flexible member 71 into contact with the inside diameter of the expanded tubing region 70 of the first member portion 11. This radial expansion of the first flexible member 71 locks the screw 76 relative to the first member portion 11. The second flexible member 72 also comprises a through aperture 72A with a second nut 82 being vulcanized or otherwise secured to the second flexible member 72. Accordingly upon rotation of first member portion 11 relative to second member portion 12, nut 82 causes longitudinal compression and radial expansion of the second flexible member 72 to contact the inside diameter of second member portion 12. This longitudinal compression of second flexible member 72 is shown in FIG. 9 wherein the first member portion 11 is located relative to the second member portion 12.

Figure 10:
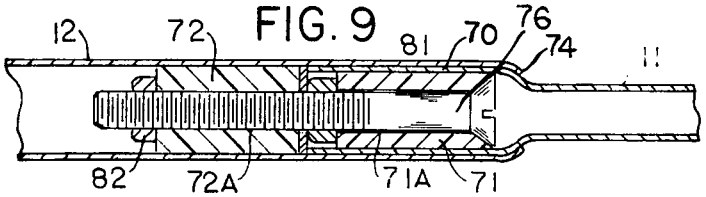
FIG. 10 illustrates a longitudinal compression of the rotatable locking means of FIG. 9.
Figure 11:
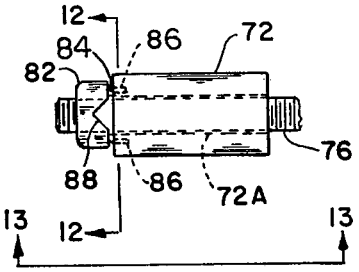
FIG. 11 is a side elevational view of a modification of the invention shown in FIGS. 9 and 10.
Figure 12:
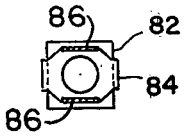
FIG. 12 is a sectional view along line 12—12 of FIG. 11.
Figure 13:
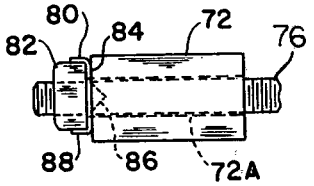
FIG. 13 is a bottom view along line 13—13 of FIG. 11.

FIGS. 11–13 show a variation of the invention shown in FIGS. 9 and 10. In this embodiment, a clip 84 is disposed between the second flexible member 72 and the second nut 82. Clip 84 prevents rotation between the nut 82 and the flexible member 72. The clip 84 includes plural projections 86 extending into the second flexible member 72 and plural tabs 88 for surrounding the second nut 82. The rotatable locking of the means set forth in FIGS. 9–12 provides a simple and reliable system for rotatably locking the telescopic first and second member portions of the handle member 8.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described:

What is claimed is:

1. A shuffleboard cue with facile tip changing capability, comprising in combination:

an elongated handle member having a gripping portion at one end thereof and a yoke extending from the other end of said handle member;

said yoke having a substantially "U" shape and secured at the apex thereof to said handle member and with spaced arms extending to a first and second terminus;

each terminus having a mounting system for removably securing a pusher contact shoe thereon, each system including:

a pusher contact shoe having a predetermined thickness and pin engaging means means through said thickness, a pin of a length greater than said predetermined thickness of a shoe, said pin said secured to each of said yoke arm adjacent the terminus thereof and extending outwardly therefrom said pin engaging means attaching said shoe on said pin by an interfitting engagement whereby said shoe is installed on or removed from said pin and a removable locking clip engageable to the projecting end of the pin to form a removable securing means for securing said pusher shoe on said pin;

whereby said pusher shoe is pivotable by gravity on said pin and is replaceable by substitute shoes according to player preference.

2. A shuffleboard cue with facile tip changing capability, comprising in combination:

an elongated handle member having a gripping portion at one end thereof and a yoke extending from the other end of said handle member;

said yoke having a substantially "U" shape and secured at the apex thereof to said handle member and with spaced arms extending to a first and second terminus;

each terminus having a mounting system for removably securing a pusher contact shoe thereon, each system including:

a pusher contact shoe having a predetermined thickness and pin engaging means through said thickness, a first pin of a length greater than the thickness of said pusher shoe, said pin being secured to a yoke arm adjacent the terminus thereof and extending outwardly thereof, a second pin of substantially equal length of said first pin and secured a distance from said terminus and spaced from said first pin, said pusher contact shoe being pivoted on said first pin;

said pin engaging means attaching said shoe on said first pin by an interfitting engagement whereby said shoe is installed on or removed from said; and a removable locking clip engageable to the projecting ends of said first and second pin to form a cage securing said pusher shoe to the yoke terminus;

whereby said pusher contact shoe is pivotable by gravity on said pin and is replaceable by substitute shoes according to player preference.

3. A shuffleboard cue as set forth in claim 2, wherein each of said first and second pins comprises a front and a rear pin established parallel to one another.

4. A shuffleboard cue as set forth in claim 3, wherein said clip extending about said front and said rear pin.

5. A shuffleboard cue as set forth in claim 1 or 2, wherein said handle member comprises a first and a second member portion, said first member portion being telescopically receivable in said second member portion;

a rotatable lock means for securing the position of the first member portion relative to the second member portion;

said rotatable lock means including a threaded member;

first means expandable internally of the first portion for securing said threaded member to the first member portion; and second means expandable internally of the second portion upon relative rotation between said first and second member portion for securing said threaded member relative to said second member portion.

6. A shuffleboard cue as set forth in claim 5, wherein said first and second means expandable internally of the portions comprise an elastomeric member being freely extendable upon longitudinal compression.

* * * * *